United States Patent [19]

Sizer et al.

[11] Patent Number: 4,938,060

[45] Date of Patent: Jul. 3, 1990

[54] DOWNHOLE INSPECTION SYSTEM

[75] Inventors: Phillips S. Sizer; Henry P. Arendt, both of Dallas; Charles C. Cobb, Lewisville, all of Tex.

[73] Assignee: Otis Engineering Corp., Dallas, Tex.

[21] Appl. No.: 292,330

[22] Filed: Dec. 30, 1988

[51] Int. Cl.[5] ..... E21B 47/00

[52] U.S. Cl. ..... 73/151; 358/100; 367/35

[58] Field of Search ..... 73/151, 155; 358/100; 181/102, 105; 367/35, 86; 166/65.1, 255

[56] References Cited

U.S. PATENT DOCUMENTS

| | | | |
|---|---|---|---|
| 2,912,495 | 11/1959 | Moon et al. | 358/100 |
| 3,984,627 | 10/1976 | Galerne | 358/100 |
| 4,780,858 | 10/1988 | Clerke | 367/35 |

*Primary Examiner*—Hezron E. Williams
*Assistant Examiner*—Kevin D. O'Shea
*Attorney, Agent, or Firm*—Johnson & Gibb

[57] ABSTRACT

A system and methods for the inspection of a well borehole and the formation around said borehole. The system includes a coiled tubing unit for injecting flexible coiled tubing into a wellbore through a wellhead, a pump and valves for control of injection of fluids such as water, nitrogen, light-hydrocarbons, natural gas, and carbon dioxide through the coiled tubing into the wellbore, and a sensor for visually inspecting and/or acoustically examining the wellbore and a region around the sensor within a slug of fluid injected into the wellbore from the coiled tubing. The method includes the steps of injecting coiled tubing having an inspection sensor into a wellbore to a selected location, injecting an optically transparent or acoustically homogenous fluid into the wellbore through the coiled tubing to form a slug of such fluid around the sensor, and transmitting signals from the sensor representative of well conditions to the surface. The method may be practiced to inspect only the region around the sensor at a selected depth in the well or may be continuously practiced to examine the length of the wellbore by producing the well and retrieving the coiled tubing and sensor at a controlled rate synchronized with the rate of well production.

41 Claims, 3 Drawing Sheets

DOWNHOLE INSPECTION SYSTEM

BACKGROUND OF THE INVENTION

1. Field of the Invention

The invention relates to inspection systems and, more particularly, to a system for enabling an unobstructed optical or acoustic inspection of physical conditions within a borehole. The invention may be practiced during maintenance and servicing of oil, gas, geothermal, and injection wells.

2. History of the Prior Art

In the drilling and production of oil and gas wells, it is often necessary to obtain at the surface information concerning conditions within the borehole. For example, tools and other objects may become lodged in the borehole during the drilling of a well. Such objects must be retrieved before drilling can continue. When the removal of foreign objects from a borehole is undertaken, known as "fishing", it is highly desirable to know the size and shape of the obstructing object in order to select the proper fishing tool to grasp the object and remove it from the borehole. Such information is very difficult to obtain because of the hostile downhole environment within a borehole filled with opaque drilling fluids.

In the operation and/or periodic maintenance of producing or injection wells, it is also frequently necessary to obtain information about the construction and/or operating condition of production equipment located downhole. For example, detection of the onset of corrosion damage to well tubing or casing within a borehole enables the application of anti-corrosive treatments to the well. Early treatment of corrosive well conditions prevents the highly expensive and dangerous replacement of corrosion damaged well production components. Other maintenance operations in a production well environment, such as replacement of various flow control valves or the inspection of the location and condition of casing perforations, make it highly desirable for an operator located at the surface to obtain accurate, real-time information about downhole conditions. The presence of production fluids in the well renders accurate inspection very difficult.

Various techniques have been proposed for obtaining at the surface information about the conditions within a borehole. One approach has been to lower an acoustic inspection device into the borehole to transmit acoustic energy in the zone of inspection and receive and analyze the reflected acoustic energy as indicia of downhole conditions. Such a system is shown in U.S. Pat. No. 4,766,577 to Clerke et al. A major problem with such acoustic devices is that it is very difficult to obtain a high degree of resolution of details with such acoustic systems. In addition, the presence of non-homogenous borehole fluids produces random scattering of the acoustic energy resulting in even further inaccuracies and distortions of the reflected waveforms.

Television cameras have also been used in prior art downhole inspection systems in an attempt to allow an observer at the surface to obtain an accurate view or recording of physical conditions within a borehole. Such systems are shown in U.S. Pat. Nos. 2,852,600 to Jenkins Jr., 2,912,495 to Moon et al., and 4,229,762 to Healy. A significant drawback inherent in such systems is that the presence of optically opaque borehole fluids obscures the view of such cameras unless the point of observation is directly adjacent the outside of the surface of the lens housing. This is a serious limitation of the applicability of television systems to borehole inspection apparatus.

One attempt to solve this problem with television inspection systems is set forth in U.S. Pat. No. 2,849,530 to Fleet wherein it is proposed pump a slug of clear liquid from the surface down to the point of observation. While this approach is a good attempt to deal with this problem, it is impractical because the difficulty of accurately positioning the slug of clear liquid when the camera is located a substantial distance from the surface. Also, some underground formations may be damaged by fluid injection. Further, the slug of clear liquid will also become mixed with opaque production and/or borehole fluids during its journey from the surface to the downhole location of the camera and thereby be rendered either opaque or translucent by the time it reaches the downhole camera.

It would be a major improvement in downhole inspection systems if a optically clear or acoustically homogenous fluid could be directly injected into the borehole in the zone where inspection is desired. The present invention provides such a system.

SUMMARY OF THE INVENTION

The present invention is directed toward an improved method and apparatus for inspecting the interior of a borehole.

In one aspect, the system of the present invention provides a fluid conduit extending from the surface of a borehole to a location within the borehole at which inspection is desired. An inspection sensor is mounted to the conduit near the lower end thereof for sensing the downhole borehole conditions. At the surface, there is connected to the conduit a means for a pumping a selected quantity of clear fluid down the conduit from the surface and out into the borehole in the zone of inspection. The fluid forms an optically transparent or acoustically homogenous region within the borehole adjacent the zone of inspection to allow the accurate inspection of conditions in the borehole by the sensor. The sensor may either directly record the results of its inspections or relay information to the surface related to the results of its inspection for use by an operator.

In another aspect, the invention includes forming a narrow zone of optically transparent or acoustically homogenous fluid within an inspection zone inside a borehole to allow an inspection sensor to accurately observe conditions within the borehole.

In a further aspect, the invention comprises a method and system for inspecting the interior of a borehole including a length of conduit extending from the surface adjacent the borehole down into the zone where inspection is to occur. A sensor is mounted adjacent the lower end of the tubing for inspecting conditions within the borehole. A fluid which provides a medium conducive to accurate inspection of conditions within the borehole by the sensor is pumped down the conduit from the surface and out the lower end thereof into an inspection region adjacent the sensor.

In still another aspect, the invention includes a method and system for inspecting the interior of a borehole in which a coiled tubing unit, including a reel having a length of tubing wound thereon, is used to insert the tubing on the reel down into a borehole to a location at which inspection is to occur. An inspection sensor is mounted to the end of the coiled tubing to be inserted into the borehole and a pump is connected to the end of the coiled tubing located at the surface for supplying pressurized optically transparent and/or acoustically homogenous fluid to the coiled tubing. A fluid injection nozzle is mounted to the lower end of the coiled tubing and in fluid communication with the interior of the tubing for allowing a flow of fluid from within the tubing out into the borehole. The operation of the fluid injection nozzle is controlled to allow the flow of a selected quantity of optically clear and/or acoustically homogenous fluid from within the tubing into the borehole to produce a clear fluid inspection zone within the borehole in the region of the sensor and enable the sensor to accurately inspect physical conditions within the borehole.

The invention may be used to inspect only a desired region in the borehole by holding the lower end of the coiled tubing with the sensor at a fixed depth in the borehole. Alternatively, the borehole may be inspected from a pre-selected depth to the wellhead by producing the well while moving the coiled tubing and sensor upwardly while maintaining an optically clear fluid slug or pill around the sensor as the tubing lower end and sensor are retrieved.

The acoustic inspections performed with the methods and system of the invention may include the casing/cement bond, the cement sheath around the borehole, and the near-borehole formations.

BRIEF DESCRIPTION OF THE DRAWING

For a more detailed understanding of the present invention and for further objects and advantages thereof, reference can now be had to the following description taken in conjunction with the accompanying drawing, in which.

DETAILED DESCRIPTION OF THE PRESENT INVENTION

Figure 1:
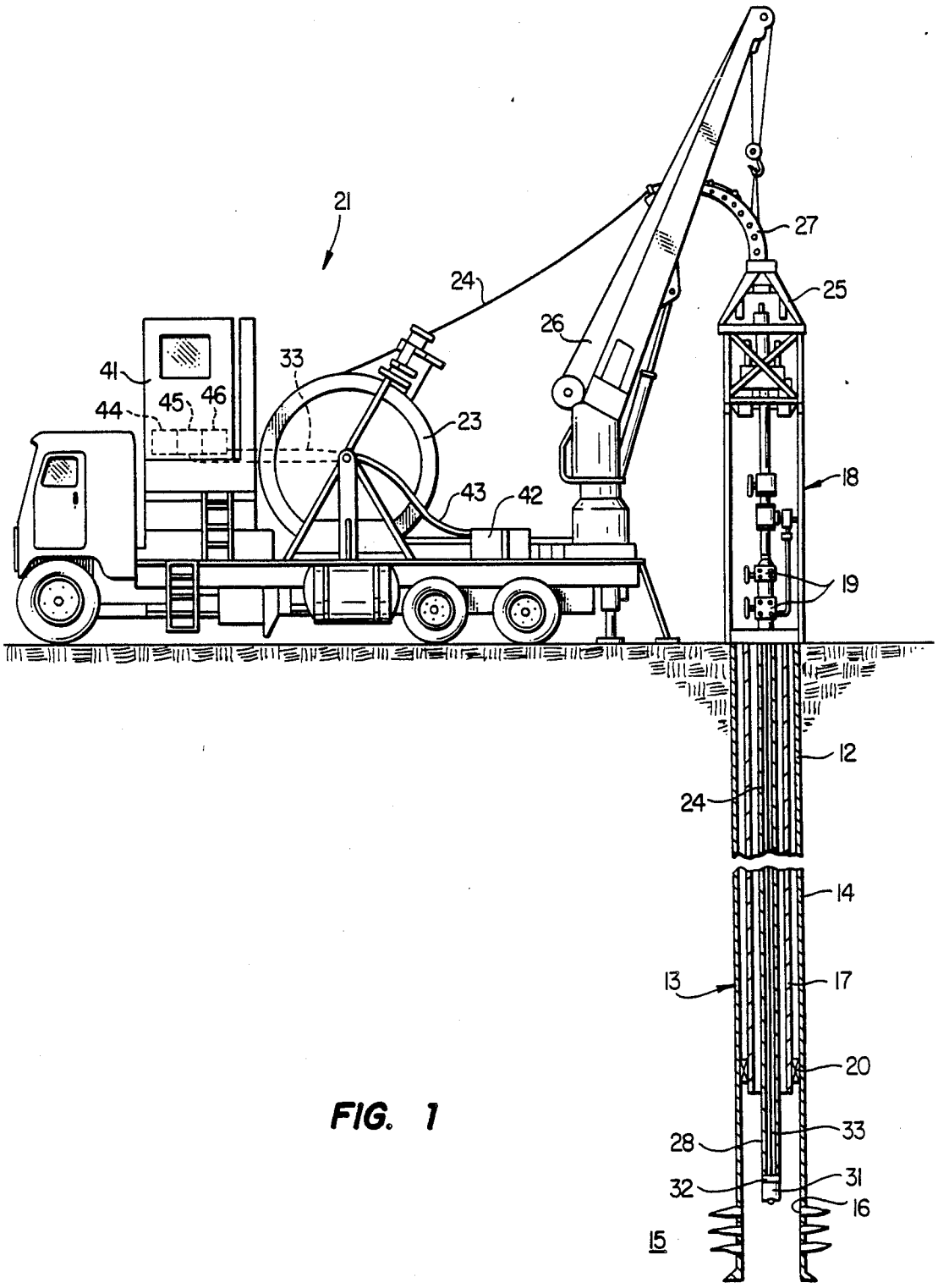
FIG. 1 is an illustrative schematic drawing, partially in elevation and partially in cross-section, showing a borehole inspection system constructed in accordance with the teachings of the present invention.

Referring to FIG. 1, there is shown a borehole 12 forming part of a completed production well 13 which includes a casing 14 extending from the surface to the production zone 15 of the well. The casing includes a plurality of perforations 16 formed in the wall thereof to allow the influx of production fluids from the producing formation into the borehole for removal at the wellhead. A production packer 20 is positioned between the tubing 17 and the casing 14 above the production zone 15.

A string of production tubing 17 extends from the wellhead production completion equipment 18, known as a "Christmas tree", to allow the fluids flowing into the casing 14 from the formation to be received at the surface for collection as production fluids from the well. The various valves 19 at the wellhead 18 control the flow of production fluids brought to the surface through the tubing 17.

Also shown in FIG. 1 is an item of production well maintenance equipment 21 known as a coiled tubing unit. This system comprises a truck 22 onto the bed of which is mounted a large mechanically operated reel 23 upon which is wound a continuous length of metal tubing 24 capable of withstanding relatively high pressures. The tubing 24 is slightly flexible so as to be able to allow coiling of the tubing onto the reel 23. A coil tubing injector unit 25 is positioned over the wellhead 18 by a hydraulic crane 26 and is directly attached to the wellhead. The injector 25 includes a curved guide way 27 and a hydraulic means for injecting the coil tubing 24 down into the well tubing 17 while the well remains under production pressure. A sufficient length of tubing 24 is inserted into the well that the lower end of the coil tubing 28 extends out the lower end of the production tubing 17 into the region of the borehole inside of the casing 14. The production zone 15 is deemed, for purposes of illustration, to be the borehole inspection zone of interest. An inspection sensor 31 is shown positioned in that region.

Attached to the lower end of the coiled tubing 28 is a downhole inspection sensor assembly 31 and a fluid injection nozzle 32 which is in fluid communication with the inside of the coiled tubing 24. An electrical cable 33 is connected to the sensor 31 and extends longitudinally up the interior of the coil tubing 24 to receiving and control equipment located at the surface adjacent the wellbore. The tubing 24 conducts injection fluid to a precise location within the borehole as well as protects the length of communication cable 33 extending between the inspection sensor 31 and the surface.

The coiled tubing unit 21 also carries an operator control housing 41 and a pump 42 connected to the upper end 43 of the coil tubing 24 to supply pressurized fluid into the tubing from the surface. The pump 42 is connected to a supply of fluid (not shown). A pump control console 44 is located within the operator housing 41 and adapted to control the operation of the pump 42. The upper end of the electrical cable 33 extending longitudinally along the interior of the coiled tubing 24 is connected to a sensor control unit 45 and to a sensor monitor 46 both of which are located within the operator housing 41.

The sensor assembly 31 may include, for example, a television camera or an acoustical transmitter/receiver. Alternatively other types of inspection devices such as conventional photographic cameras or high energy radiation sensors might also be employed for particular applications. In the event that a television camera is used as the sensor, the downhole assembly 31 would also include a lighting system and the cable 33 would carry both electrical power downhole to power the lights and camera as well as video signals back uphole from the camera to the sensor control unit 45 and television monitor 46. In addition, the sensor control unit 45 also includes a video recording system for providing a permanent record of the borehole inspection signal produced by the television camera.

Figure 2:
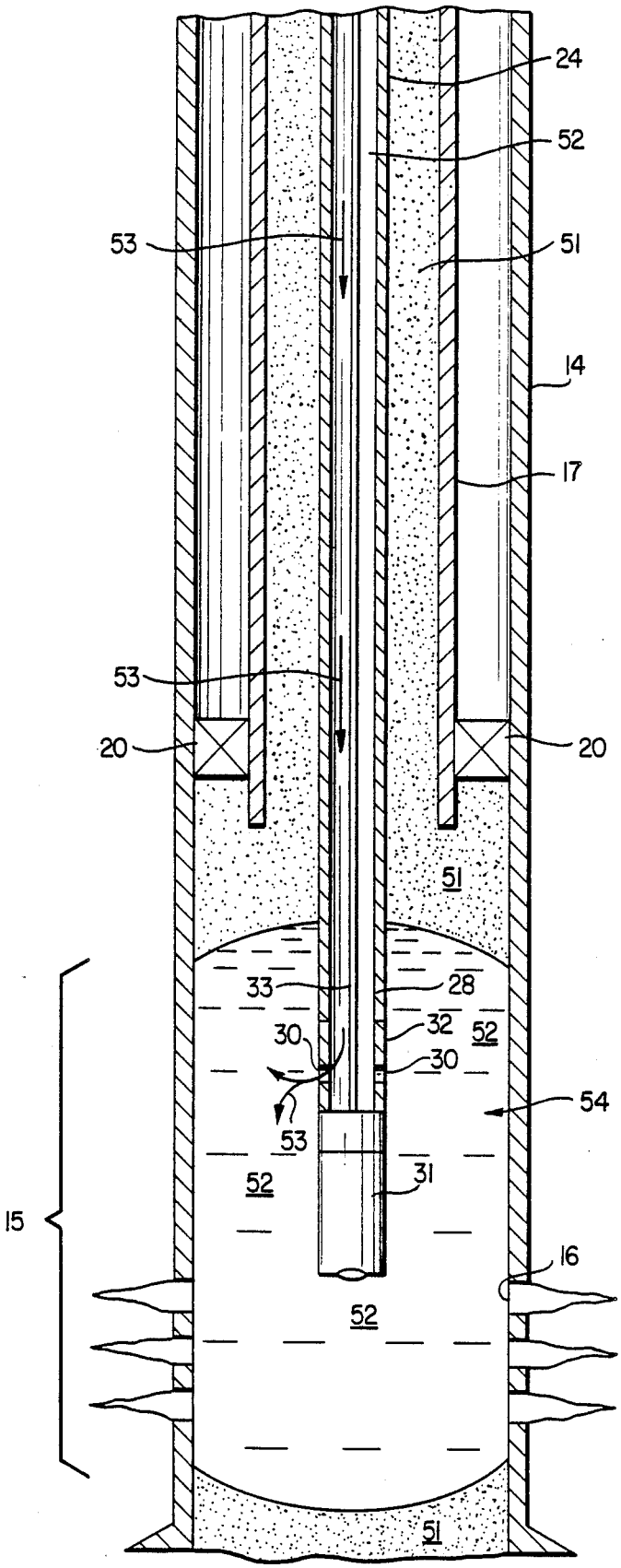
FIG. 2 is an elevational cross-section view of the lower end of the tubing showing the sensor of the inspection system shown in FIG. 1 and the zone of inspection within the borehole.

Referring now to FIG. 2, there is shown an enlarged cross-sectional view of the lower end 28 of the coiled tubing 24 and the borehole inspection zone 15. The lower end of the production tubing 17 is sealed on the outside against the inner wall of the casing 14 by means of the production packer 20. Production fluids 51 which flow into the casing 14 through the perforations 16, travel up the tubing 17 toward the wellhead. The production fluids 51 generally comprise oil, salt water, and other opaque and frequently non-homogenous fluids.

As discussed above in connection with FIG. 1, the pump 42 is connected to the upper end 43 of the coiled tubing 24 and to a supply of fluid. From the surface, an optically clear and/or acoustically homogenous fluid 52, from the source connected to pump 42, is pumped down the coiled tubing 24 in the direction of arrows 53 and toward the nozzle 32 in the lower end 28 of the coiled tubing. This fluid forms an isolated zone or "pill" 54 of optically transparent and/or acoustically homogenous fluids 52 in the region of the inspection sensor 31. This enables the sensor 31 to accurately inspect the interior conditions within the borehole. For example, with the injection of pill 54 of clear fluid the condition of the inner side walls of the casings 14 can be optically and/or acoustically inspected without any obstruction from the opaque, non-homogenous borehole fluids 51 normally present within the borehole. Signals produced by the sensor 31 are relayed up the cable 33 to the sensor monitoring and control unit 45 within the operator housing 41 located at the surface.

The fluid 52 which is forced down the coiled tubing 24 under pressure by means of the pump 42 located in the surface, may comprise a number of different fluids depending upon the inspection sensor selected for the particular application and operating conditions. For example, a clear fluid media such as water, nitrogen, light hydro-carbons, natural gas, $CO_2$, and many others may be both acoustically homogenous and optically clear and thus provide a suitable medium for careful and accurate inspection of the downhole conditions by the sensor.

The inspection sensor 31 may comprise any number of sensors, devices and systems including video, acoustic, and others. The means for signal transmission from the sensor back uphole could be by the cable 33, as shown, or by other suitable means such as fluid pulse modulation, wave guide, or radio transmission. The flow head located at the lower end of the coil tubing section 28 adjacent the sensor assembly 31, including the flow control nozzles 32, may include a downhole connection means and may control the flow rate and/or direction of the inspection fluid medium 52. The clear medium 52 can be injected down the coiled tubing 24 either in batch mode or in a continuous mode. The latter is particularly useful where the sensor assembly 31 is moved longitudinally along the borehole as, for example, in making a longitudinal inspection survey along the length of the borehole as to the conditions therein.

While the illustrative embodiment of the system of the present invention has been shown in a production well environment, the system of the present invention could also be used in an open hole, a cased hole, within a drill pipe, or in a production-completed well as is illustrated. Borehole conditions may also be inspected by means of the present invention whether the borehole is vertical, deviated, or horizontal in configuration. It should also be noted that while a coiled or reeled tubing is shown in the specific embodiment discussed, the conduit used to support the inspection sensor and inject the pill of clear liquid into the other borehole fluids could also include jointed pipe of various types.

Figure 3:
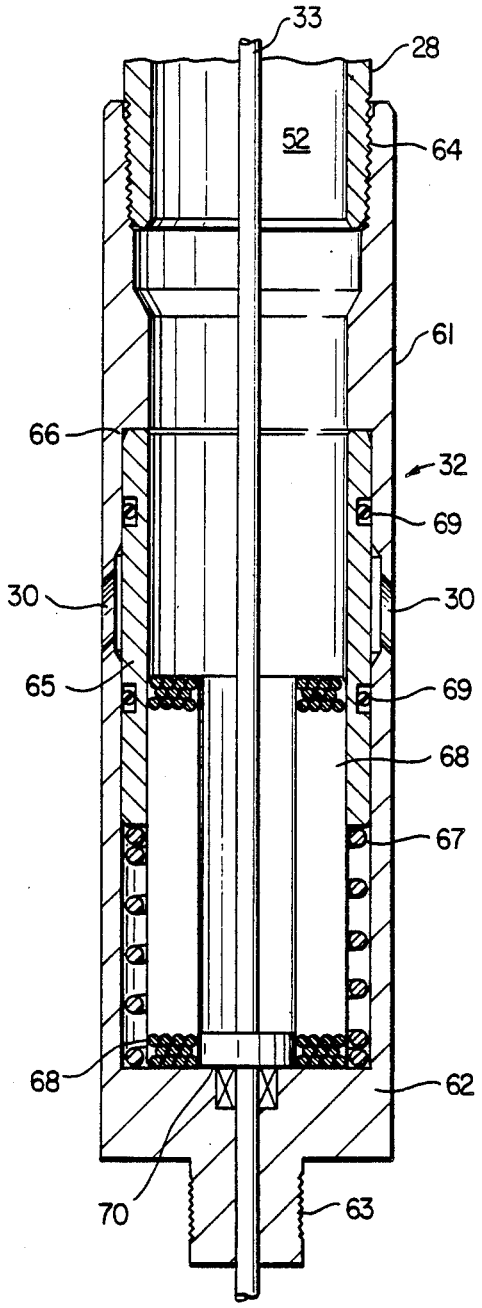
FIG. 3 is a vertical cross-section view of one embodiment of a flow control valve used in conjunction with the system of the present invention.

Referring now to FIG. 3, there is shown an illustrative embodiment of a fluid media control valve 32 which can be used in the fluid injection nozzle 32 attached to the lower end of the coiled tubing 28. The flow control valve 32 illustratively comprises a cylindrical outer housing 61 closed at the lower end 62 and having a threaded axial projection 63 to which can be attached the inspection sensor described above. The open upper end of the control valve body 61 includes internal threads 64 which receive the threaded lower end of the coiled tubing 28. A plurality of openings 30 in the side walls of the housing 61 provide outlet openings for fluid 52 pumped down the length of the coiled tubing 24 from the surface to exit from the fluid injection nozzle 32 of the tubing in a selective manner under control of the valve 31.

An inner armature 65 is mounted for axial movement within the inner walls of the housing 61 and is received against an abutting shoulder 66 at its upper end. The armature 65 is biased in the upper direction by means of a helical coil spring 67 to hold it in position against the abutting shoulder 66. In this normally spring biased condition, the side walls of the armature 65 close the openings 30 and prevent the egress of fluid 52 from within the body of the valve 32. A solenoid coil 68 is positioned within the body of the cylindrical housing 61 and comprises a plurality of turns of electrical conductor. The electrical conductor of the solenoid 68 is connected to electrical conductors contained within the cable 33 in connector 70 or to a control circuit (not shown). Upon selective energization of the solenoid coil 68, by means of the control of electrical current flow from the surface down the cable 33, the armature 65 is drawn down past the upper edges of the openings 30 so that fluid 52 is allowed to pass from within cylindrical housing 61 of the valve 32 and into the borehole. The side walls of the armature 65 are sealed to the inner walls of the cylindrical housing 61 by means of a plurality of seals 69 received into mounting channels in the side walls of the armature 65. De-energization of the solenoid coil 68 allows the helical bias spring 67 to return the armature 65 to its uppermost position in the housing 61 and again close the openings 30 and prevent the flow of any fluid 52 from within the lower end of the coiled tubing.

It should also be understood that similar embodiments of such flow control valves could also be hydraulically actuated as well.

Referring again to FIGS. 1 and 2, one method of operation of the system of the present invention is as follows. The coiled tubing unit 21 is positioned above the wellhead of a borehole 12 to be inspected and the coiled tubing injector 25 is used to inject a length of the tubing 24 down the production tubing 17 extending into the borehole. The inspection sensor 31 and the flow control nozzle 32 is carried on the lower end of the coiled tubing 28 into the borehole.

When the lower end of the coiled tubing 28 has reached the location of the inspection zone 15 within the borehole where it is desired to begin inspection, the pump 42 is used to force an optically clear and/or acoustically homogenous fluid from a supply thereof located at the surface down the length of coiled tubing 24 under control of the pump control unit 44. When a sufficient quantity of optically clear and/or acoustically homogenous fluid 52, as illustrated in region 54 of FIG. 2, has been ejected from the lower end of the coiled tubing 28 so as to create an optically and/or acoustically transparent region 54 in the zone adjacent the inspection sensor assembly 31, inspection is begun. The inspection sensor 31 is enabled by means of the "pill" 54 of homogenous fluid 52 to accurately inspect the conditions within the zone of the transparent region 54 and provide a signal up the cable 33 to the sensor control panel 45 and the sensor monitor 46. At this location, an operator at the surface can accurately monitor the downhole conditions and create a record of the downhole conditions by means of a recording device.

As mentioned above, injection of the optically transparent fluid zone 54 into the optically opaque production fluids 51 may be either a one time batch operation to allow inspection or on a continuous basis as necessary. Once the zone of transparent fluid 54 is in place, in many cases, it will be immiscible with the production fluids 51 and remain in place regardless of the length of time required for inspection. In addition, the fluid may be injected continuously and the lower end of the reeled tubing 28, carrying with it the sensor assembly 31, moved axially along the length of the borehole to provide a continuous record of inspection of the interior conditions of the borehole. For example, movement of the sensor can be used to inspect the side walls of the casing 14 for any pits or other signs of corrosion indicating the need for beginning of corrosion treatment of the production well. By way of another example, in the event that the borehole being inspected was a well being drilled, the opaque fluid 51 might comprise drilling muds and the transparent fluid region 54 would allow the inspection of the exact nature, shape and characteristics of a broken tool lodged within the borehole and in need of removal. Further, the invention will allow open hole inspection of the formation during drilling or after open hole fracturing, "open hole" meaning that casing is not installed in the wellbore.

If the well is capable of producing, the method of the invention may be used to inspect the wellbore from the producing zone to the wellhead. The well is produced at a desired controlled rate. An optically clear fluid, a clear gas such as nitrogen, is injected at a controlled rate to form a bubble around the sensor 31. The coiled tubing 24 is retrieved at a rate corresponding to the rate of well production and the tubing retrieval rate and production rate are adjusted to maintain the sensor within the optically clear bubble inspecting the borehole from the selected downhole location to the wellhead. It will be recognized that when the fluid employed is gas the bubble will enlarge as the bubble moves up the borehole due to the progressive reduction of pressure around the sensor from the downhole location to the wellhead. A clear liquid slug or bubble, on the other hand, will remain the same size as the decreasing pressure will not cause the volume of the liquid to increase.

As discussed above, a preferred embodiment of the present invention includes a sensor in the form of a television camera together with the necessary lighting to allow real-time optical inspection and the production of a video signal of the cable 33 to monitoring and recording equipment located at the surface. In such cases, the fluid "bubble" or "pill" 54 would necessarily be an optically transparent region to allow optical inspection of the interior of the borehole by the television camera.

It is thus believed that the operation and construction of the present invention will be apparent from the foregoing discussion. While the method, apparatus and system shown and described has been characterized as being preferred, it would be obvious that various changes and modifications may be made therein without departing from the spirit and scope of the invention as defined by the following claims.

What is claimed is:

1. A system for inspecting conditions in and around a borehole, comprising:

a length of conduit extending from the surface through the borehole down into the zone where inspection is to occur;

a sensor mounted on the lower end of said conduit for inspecting conditions within the borehole; and means for pumping from the surface down the conduit into an inspection region adjacent the sensor, a fluid which provides a medium conducive to accurate inspection of conditions within the borehole by the sensor.

2. A system for inspecting the interior of a borehole as set forth in claim 1, wherein the sensor is a camera and the fluid pumped down the conduit is optically transparent.

3. A system for inspecting the interior of a borehole as set forth in claim 2, wherein the sensor is a television camera.

4. A system for inspecting the interior of a borehole as set forth in claim 1 wherein the conduit comprises the tubing of a coiled tubing unit.

5. A system for inspecting conditions in and around a borehole, comprising:

a length of conduit extending from the surface through the borehole down into the zone where inspection is to occur;

an acoustic transmitter and receiver mounted near the lower end of said conduit for acoustically inspecting conditions within and around the borehole; and means for pumping from the surface down the conduit into an inspection region adjacent the sensor, an acoustically homogenous fluid which provides a medium conducive to accurate inspection of conditions within the borehole by said sensor.

6. A system for inspecting a borehole as set forth in claim 1 wherein the lower end of the tubing also includes a flow control valve for controlling the egress of fluids from within the conduit into the borehole.

7. A system for inspecting a borehole as set forth in claim 6 wherein said flow control valve comprises an electrically operated solenoid control valve.

8. A system for inspecting a borehole as set forth in claim 6 including a hydraulically operated flow control valve.

9. A method for inspecting the interior of a borehole, comprising:

providing a length of conduit extending from the surface adjacent the borehole down in the borehole into the zone where inspection is to occur;

providing a sensor mounted on the lower end of said conduit for inspecting conditions within the borehole; and pumping from the surface down the conduit and out the lower end thereof into an inspection region adjacent the sensor, a fluid which provides a medium conducive to accurate inspection of conditions within the borehole by the sensor.

10. A method for inspecting the interior of a borehole as set forth in claim 9, wherein the sensor is a camera and the fluid pumped down the conduit is optically transparent.

11. A method for inspecting the interior of a borehole as set forth in claim 10 wherein the sensor is a television camera.

12. A method for inspecting the interior of a borehole as set forth in claim 9 wherein the conduit comprises the tubing of a coiled tubing unit.

13. A method for inspecting the interior of a borehole comprising;

providing a length of conduit extending from the surface adjacent the borehole down in the borehole into the zone where inspection is to occur;

providing an acoustic transmitter and receiver mounted adjacent the lower end of said conduit for acoustically inspecting conditions within and around the borehole; and pumping from the surface down the conduit and out the lower end thereof into an inspection region adjacent the sensor, an acoustically homogenous fluid which provides a medium conducive to accurate inspection of conditions within the borehole by said acoustic sensor.

14. A method for inspecting the interior of a borehole as set forth in claim 9 wherein the lower end of the tubing also includes a flow control valve for controlling the egress of fluids from within the conduit into the borehole.

15. A method for inspecting the interior of a borehole as set forth in claim 14 wherein said flow control valve comprises an electrically operated solenoid control valve.

16. A method for inspecting the interior of a borehole as set forth in claim 14 wherein said flow control valve is hydraulically operated.

17. A system for inspecting the interior of a borehole, comprising:

a coiled tubing unit including a reel having a length of tubing wound thereon and an injector for inserting the tubing on the reel down into a borehole to a location at which inspection is to occur;

an inspection sensor mounted to the end of the coiled tubing to be inserted into the borehole;

a pump connected to the end of the coiled tubing located at the surface for supplying pressurized optically transparent and/or acoustically homogenous fluid to said coiled tubing;

a fluid injection nozzle means mounted to the lower end of the coiled tubing and in fluid communication with the interior of the tubing for allowing a flow of fluid from within the tubing out into the borehole; and means for controlling the operation of said fluid injection nozzle to allow the flow of a selected quantity of optically clear and/or acoustically homogenous fluid from within the tubing into the borehole to produce a clear fluid inspection zone within the borehole in the region of the sensor and enable said sensor to accurately inspect physical conditions within the borehole.

18. A system for inspecting the interior of a borehole as set forth in claim 17, wherein said fluid injection nozzle control means includes an electrical cable extending along the length of the coiled tubing connecting said nozzle with the surface to allow communication therewith by an operator.

19. A system for inspecting the interior of a borehole as set forth in claim 18, wherein said electrical cable extends through the interior of said coiled tubing to protect said cable from damage.

20. A system for inspecting the interior of a borehole as set forth in claim 17, which also includes:

means located at the surface for controlling the operation of said inspection sensor and for receiving information from the operation of said sensor; and an electrical cable extending along the length of said coiled tubing for connecting said inspection sensor with said controlling and receiving means at the surface to allow communication with said sensor by an operator.

21. A system for inspecting the interior of a borehole as set forth in claim 19, wherein said electrical cable extends through the interior of said coiled tubing to protect said cable from damage.

22. A system for inspecting the interior of a borehole as set forth in claim 20, which also includes:

means located at the surface and connected to said electrical cable for recording signals from said inspection sensor which are representative of conditions within the interior of the borehole.

23. A system for inspecting the interior of a borehole as set forth in claim 20, which also includes:

means located at the surface and connected to said electrical cable for monitoring signals from said inspection sensor which are representative of conditions within the interior of the borehole.

24. A system for inspecting the interior of a borehole as set forth in claim 20, wherein said inspection sensor comprises a television camera and a lighting system.

25. A system for inspecting the interior of a borehole as set forth in claim 24, wherein said receiving means includes a television monitor.

26. A system for inspecting the interior of a borehole as set forth in claim 17, which also includes:

means located at the surface for controlling said pump.

27. A system for inspecting the interior of a borehole as set forth in claim 17, wherein said coiled tubing unit is mounted upon a truck for transportation to the location of the borehole to be inspected.

28. A method for inspecting the interior of a borehole comprising:

providing a coiled tubing unit including a reel having a length of tubing wound thereon, an inspection sensor mounted to the unwound end of the coiled tubing, and a fluid injection nozzle mounted to the unwound end of the coiled tubing which is in fluid communication with the interior of the tubing for allowing the flow of fluid from within the tubing;

inserting the coiled tubing down into the borehole to a location at which inspection is to occur;

pumping an optically transparent and/or acoustically homogenous fluid into the coiled tubing from the surface; and controlling the operation of the fluid injection nozzle to allow the flow of a selected quantity of optically clear and/or acoustically homogenous fluid from within the tubing into the borehole to produce a clear fluid inspection zone within the borehole in the region of the inspection sensor and enable the sensor to accurately inspect physical conditions within the borehole.

29. A method for inspecting the interior of a borehole as claimed in claim 28, which also includes:

providing an electrical cable extending from the surface to the sensor to allow control thereof by an operator at the surface.

30. A method for inspecting the interior of a borehole as set forth in claim 29 which also includes:

receiving signals on the electrical cable at the surface which are indicative of the results of inspection within the borehole by the sensor.

31. A method for inspecting the interior of a borehole as set forth in claim 30, which also includes:

recording at the surface the signals received from the sensor.

32. A method for inspecting the interior of a borehole as set forth in claim 29 wherein the electrical cable is also connected to the fluid injection nozzle to allow control thereof by an operator at the surface.

33. A method for inspecting the interior of a borehole as set forth in claim 28, wherein the inspection sensor provided includes a television camera.

34. A method for inspecting the interior of a borehole as set forth in claim 28, which also includes:

selecting the optically transparent and/or acoustically homogenous fluid for pumping into the coiled tubing from the group consisting of water, nitrogen, light-hydrocarbons, natural gas and carbon dioxide.

35. A method for inspecting the interior of a borehole comprising:

providing a length of conduit extending from the surface adjacent the borehole down in the borehole into the zone where inspection is to occur;

providing a sensor mounted adjacent the lower end of said conduit for inspecting conditions within the borehole;

pumping from the surface down the conduit and out the lower end thereof into an inspection region adjacent the sensor, a fluid which provides a medium conducive to accurate inspection of conditions within the borehole by the sensor;

producing formation fluids through said borehole at a controlled rate;

retrieving said conduit with said sensor from a pre-selected depth in said borehole to the surface at a controlled rate;

and controlling the rate of production, the rate of retrieving said conduit to the surface, and the rate of pumping said fluid into said borehole adjacent said sensor to maintain a fluid slug around said sensor as said conduit with said sensor is retrieved to the surface for continuous inspection of said borehole from said pre-selected depth to the surface.

36. A method in accordance with claim 35 wherein said fluid is a clear gas.

37. A method in accordance with claim 36 wherein said gas is nitrogen.

38. A method for inspecting conditions in and around a borehole of a producing well comprising:

inserting coiled tubing having an inspection sensor mounted thereon through a wellhead downwardly into the borehole of said well to a pre-selected location in said borehole at which said inspection is to begin;

pumping an optically transparent and/or acoustically homogenous fluid into said coiled tubing from the surface to said initial inspection location in said wellbore to form a slug of said fluid around said sensor;

producing well fluids into said wellbore and upwardly in said wellbore at a controlled rate through said wellbore to the surface end of said wellbore;

retrieving said coiled tubing with said sensor at a rate corresponding with the rate of well fluid production in said wellbore; and adjusting said well fluid production rate and retrieval rate of said coiled tubing to maintain said sensor within said slug of said fluid as said slug of fluid moves from said selected depth in said well to the surface whereby said sensor can continuously inspect said wellbore from said pre-selected depth in said wellbore to said wellhead.

39. A method in accordance with claim 38 wherein said fluid is an optically clear gas.

40. A method in accordance with claim 39 wherein said fluid is nitrogen.

41. A method in accordance with claim 38 wherein said fluid is selected from the group consisting of water, nitrogen, light-hydrocarbons, natural gas, and carbon dioxide.

* * * * *

UNITED STATES PATENT AND TRADEMARK OFFICE

CERTIFICATE OF CORRECTION

PATENT NO. : 4,938,060

DATED : July 3, 1990

INVENTOR(S) : Phillip S. Sizer et al.

It is certified that error appears in the above-identified patent and that said Letters Patent is hereby corrected as shown below:

Title page, bracket 56, the following additional cited references should be added under "References Cited":

U.S. PATENT DOCUMENTS

| | | | | |
|---|---|---|---|---|
| | 4,711,122 | 12/08/87 | Angehrn et al..... | 73/151 |
| | 4,630,243 | 12/16/86 | MacLeon..... | 367/82 |

OTHER PUBLICATIONS

| | | | | |
|---|---|---|---|---|
| EU | 0,112,148 | 06/27/84 | Sumitomo Elec..... | A61B1/12 |
| UK | 2,126,372 | 03/21/84 | Laserscope, Inc..... | G2JE |
| UK | 1,590,563 | 05/26/78 | Sington..... | E1F HU |

Signed and Sealed this

Twenty-fifth Day of August, 1992

*Attest:*

DOUGLAS B. COMER

*Attesting Officer*

*Acting Commissioner of Patents and Trademarks*